US007628295B2

(12) United States Patent
Mondloch et al.

(10) Patent No.: US 7,628,295 B2
(45) Date of Patent: Dec. 8, 2009

(54) MATERIAL MANAGEMENT SYSTEM FOR CONTINUOUS FLOW OF DRYWALL COMPOUND

(75) Inventors: Steven J. Mondloch, Kaukauna, WI (US); Jeffrey L. Denkins, Kaukauna, WI (US)

(73) Assignee: Apla-Tech, Inc., Kaukauna, WI (US)

( * ) Notice: Subject to any disclaimer, the term of this patent is extended or adjusted under 35 U.S.C. 154(b) by 558 days.

(21) Appl. No.: 11/330,313

(22) Filed: Jan. 11, 2006

(65) Prior Publication Data

US 2006/0156689 A1 Jul. 20, 2006

Related U.S. Application Data

(60) Provisional application No. 60/644,726, filed on Jan. 18, 2005.

(51) Int. Cl.
*B65D 83/00* (2006.01)

(52) U.S. Cl. ..... 222/397; 222/394; 251/5

(58) Field of Classification Search ..... 222/394, 222/396–397; 251/5
See application file for complete search history.

(56) References Cited

U.S. PATENT DOCUMENTS

| | | | | | |
|---|---|---|---|---|---|
| 2,247,363 | A * | 7/1941 | Dunn | 137/496 |
| 2,378,184 | A * | 6/1945 | Carlson | 239/127 |
| 2,615,598 | A * | 10/1952 | Watkins et al. | 222/397 |
| 2,815,142 | A * | 12/1957 | Ames | 156/526 |
| 3,184,113 | A * | 5/1965 | Curtis | 222/386.5 |
| 3,258,176 | A * | 6/1966 | Raczynski | 222/397 |
| 3,788,427 | A * | 1/1974 | Fox et al. | 184/105.3 |
| 3,804,299 | A * | 4/1974 | Kain | 222/61 |
| 3,921,858 | A * | 11/1975 | Bemm | 222/146.5 |
| 4,063,618 | A * | 12/1977 | O'Dell | 184/105.2 |
| 4,391,390 | A * | 7/1983 | Howard | 222/136 |
| 4,431,117 | A * | 2/1984 | Genbauffe et al. | 222/3 |
| 4,520,953 | A * | 6/1985 | Fallon | 222/396 |
| 5,863,146 | A * | 1/1999 | Denkins et al. | 401/188 R |
| 5,902,451 | A * | 5/1999 | O'Mara et al. | 156/579 |
| 6,102,361 | A * | 8/2000 | Riikonen | 251/5 |
| 6,123,108 | A * | 9/2000 | Chen et al. | 138/30 |
| 6,484,782 | B1 * | 11/2002 | Lewis et al. | 156/578 |
| 2001/0003563 | A1 * | 6/2001 | Schauer et al. | 401/5 |

FOREIGN PATENT DOCUMENTS

EP 0631822 A1 1/1995

* cited by examiner

*Primary Examiner*—Kevin P Shaver
*Assistant Examiner*—Andrew P Bainbridge
(74) *Attorney, Agent, or Firm*—Andrus, Sceales, Starke & Sawall, LLP

(57) ABSTRACT

An apparatus is provided for permitting a substantially continuous flow of drywall compound to a wallboard joint. The apparatus includes a delivery tube for delivering drywall compound completely therethrough. The delivery tube has a first end connected to a drywall compound supply assembly fed directly by a source of pressurized drywall compound. The delivery tube also has a second end opposite the first end in communication with a drywall compound dispensing head. A normally closed, pressure sensitive valve arrangement is interposed between the second end of the delivery tube and the dispensing head for controlling the starting and stopping of drywall compound flow between the delivery tube and the dispensing head.

7 Claims, 1 Drawing Sheet

MATERIAL MANAGEMENT SYSTEM FOR CONTINUOUS FLOW OF DRYWALL COMPOUND

CROSS-REFERENCE TO RELATED APPLICATIONS

This application relates to and claims priority from U.S. Provisional Application No. 60/644,726 filed on Jan. 18, 2005.

FIELD OF THE INVENTION

This invention relates broadly to a system for managing the flow of fluid material used to erect interior building partitions. More particularly, the present invention pertains to a pressurized applicator for continuously supplying and more efficiently controlling the flow of drywall compound to wallboard joints.

BACKGROUND OF THE INVENTION

Drywall has become a dominant material in the production of interior building partitions. In particular, interior building partitions generally comprise a vertical stud wall which is used as a support for preformed drywall panels that are attached to the stud wall. Joints between adjacent panels of drywall are usually taped, and finished with joint or drywall compound. One type of apparatus or tool for applying joint compound is disclosed in U.S. Pat. No. 2,815,142 issued Dec. 3, 1957. This apparatus mechanically applies tape and joint compound contemporaneously. The apparatus includes a reservoir for joint compound which needs to be filled before applying the joint compound to the drywall surface. After the tape and the first coat of joint compound has been applied over the joint, it is typical to apply a second and sometimes even a third coat of joint compound. The second and third coats are typically applied using finishing tools such as a corner head, or a flat box.

A pneumatic apparatus for applying joint compound is disclosed in Denkins et al. U.S. Pat. No. 5,863,146 issued Jan. 26, 1999. This apparatus also needs to be filled with joint compound before applying the joint compound to the joint between adjacent panels of drywall. The apparatus is powered by compressed air which can be metered to control the application of joint compound. Several finishing attachments, such as disclosed in co-pending U.S. patent application Ser. No. 10/610,459 filed Jun. 30, 2003, can be attached to the apparatus.

When using pneumatic apparatus of the type described above, a substantial amount of time can be spent filling application tools with drywall compound. Each time a storage body on the tool needs to be filled, the drywall taping and finishing operations are interrupted which cause delays in the overall production of the building partitions. Prior art storage bodies are sized to hold an ample amount of drywall compound which significantly adds to the weight of the tool borne by an operator. In addition, when working with pressurized compressible drywall compound, issues arise in controlling certain aspects of the drywall compound flow. For example, problems have existed in stopping the flow of the drywall compound which tends to ooze out of the tool sometimes for 30 seconds after the air pressure has been cut off. This operating defect results in a wasted, messy discharge which must be cleaned up by the operator. Further problems have been experienced in the responsiveness of starting the drywall compound flow from the tool.

It is therefore desirable that the apparatus for applying drywall compound to wallboard joints be provided with a unique design and control arrangement which will overcome the deficiencies of the prior art and enhance the operability, speed and efficiency in all aspects of drywall taping and finishing operations.

SUMMARY OF THE INVENTION

It is one object of the present invention to provide a system for permitting substantially continuous flow of drywall compound to be delivered to a wallboard.

It is also an object of the present invention to provide a pressurized drywall compound applicator having improved control for starting and stopping flow of the drywall compound.

It is another object of the present invention to provide a pneumatic drywall compound supplying tool having a reduced weight which is easier to handle.

In one aspect of the invention, an apparatus is provided for permitting a substantially continuous flow of drywall compound to a wallboard joint. The apparatus includes a delivery tube for delivering drywall compound completely therethrough. The delivery tube has a first end connected to a drywall compound supply assembly fed directly by a source of pressurized drywall compound. The delivery tube has a second end opposite the first end in communication with a drywall compound dispensing head. A normally closed, pressure sensitive valve arrangement is interposed between the second end of the delivery tube and the dispensing head for controlling the drywall compound flow between the delivery tube and the dispensing head.

The delivery tube is surrounded by a protective foam sleeve. The drywall compound supply assembly includes a live swivel rotatably coupled to a needle valve and an in-line valve. The needle valve has an adjustment control for altering the volume of pressurized drywall compound supply through the in-line valve. The in-line valve includes a handle for controlling admission of pressurized drywall compound therethrough. The valve arrangement includes a pinch valve having a flexible diaphragm provided with a closing pressure for controlling the flow of pressurized drywall compound through the pinch valve. The pinch valve is joined to a flow control valve and a pre-charged air reservoir having a pressurized gauge and a charging valve and cap unit adapted to be connected to a source of pressurized air. A coupling is interposed between the pinch valve and the dispensing head. The needle valve steps down the pressure of the drywall compound delivered from the in-line valve into the delivery tube. The pressure of the drywall compound in the delivery tube overcomes the closing pressure of the diaphragm to provide a substantially continuous flow of drywall compound to the dispensing head. Alternatively valve arrangement may use a ball and spring valve.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 2:
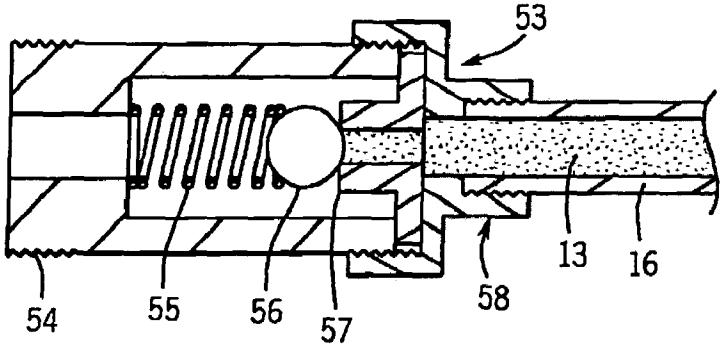
FIG. 2 is an alternative embodiment of FIG. 1 using a ball and spring valve in lieu of a pinch valve and precharged air reservoir.

In the drawing, thereshown is a pressurized apparatus 10 which defines a management system for providing a substantially continuous flow of finishing material in the form of drywall compound or "mud" to wallboard joints.

The apparatus 10 includes a hollow, stainless steel delivery tube 12 which extends lengthwise along a longitudinal axis, and delivers drywall compound 13 completely therethrough. The delivery tube 12 has an inner wall 14 having a constant inner diameter of about 7/16 inch, and an outer wall 16 surrounded entirely by a foam protective sleeve 18. The delivery tube 12 has a bottom end threadably attached to a live swivel 20 which is rotatably coupled to one end of a high pressure needle valve 22 having an adjustment control 24. The other end of the needle valve 22 is connected to an in-line valve 26 provided with an inlet 28 for receiving a supply line 30 extending from a substantially continuous source 32 of pressurized drywall compound 13. The in-line valve 26 has a handle 34 for controlling the flow of drywall compound 13 through the needle valve 22 and live swivel 20 into the delivery tube 12. The live swivel 20 allows the needle valve 22 and the in-line valve 26 to rotate 360 degrees relative thereto.

Figure 1:
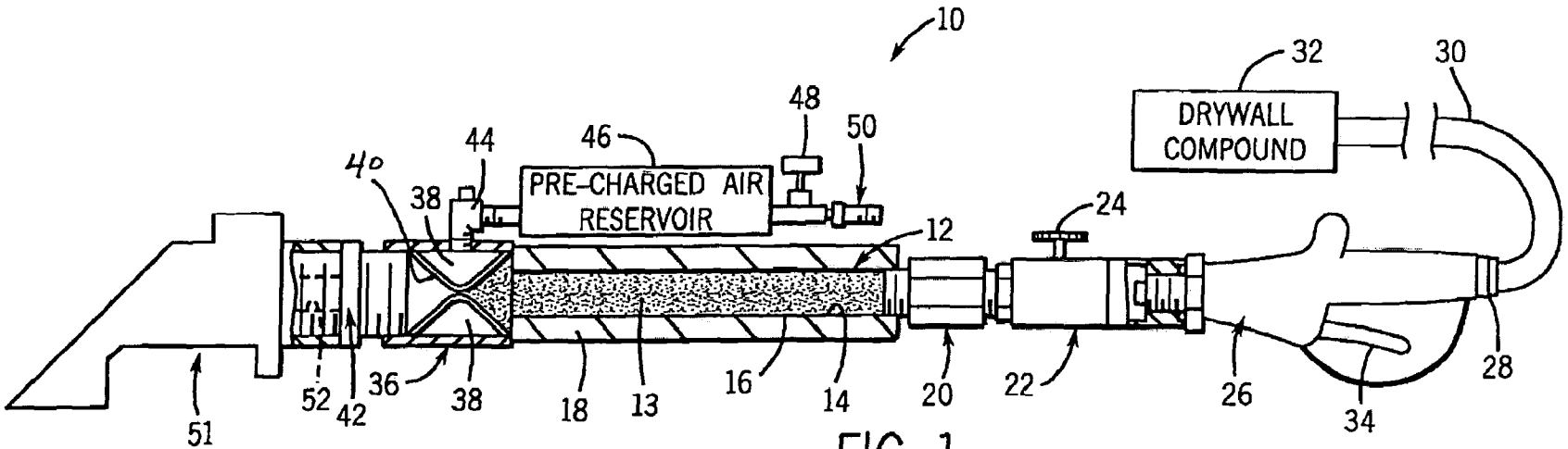
FIG. 1 is an elevational view of a pressurized drywall compound apparatus in accordance with the present invention.

The delivery tube 12 has a top end threadably secured to an air-actuated pinch valve 36 having a sealed air chamber 38 provided with a pressure sensitive, flexible bellows or diaphragm 40. The pinch valve chamber 38 has a bottom end in communication with the delivery tube 12, and a top end threadably attached and in communication with a threaded end of a coupling 42. The pinch valve 36 is joined to a flow control valve 44 which in turn is connected to a precharged air reservoir 46 lying outside the protective sleeve 18. The air reservoir 46 is coupled to a pressure gauge 48 that receives a charging valve and cap unit 50 to which an air supply line can be connected and disconnected. The coupling 42 is threadably accommodated in a portion of a drywall compound dispensing head 51 which is shown in FIG. 1 as a drywall taper head but could also be a finishing head. The coupling 42 has a throughbore 52 so that there is communication between pinch valve 36 and head 51.

It should be appreciated that the diaphragm 40 in the pinch valve 36 is preset to a closed position shown in FIG. 1 by precharging the air reservoir 46. Precharging is effected by temporarily connecting a source of pressurized air to the charging valve and cap unit 50 and disconnecting the source of air when the pressurized gauge 48 reflects the closing pressure of the pinch valve 36 which typically may be 40 pounds per square inch. The flow control valve 44 allows unrestricted flow into the pinch valve 36 but restricts outflow therefrom. If necessary, the closing pressure of the diaphragm 40 may be increased or decreased.

As will be further described below, drywall compound 13 supplied through in-line valve 26 passes through the needle valve 22, live swivel 20, delivery tube 12, pinch valve 36, and coupling 42 with the assistance of the flow control valve 44, air reservoir 46, pressure gauge 48 and unit 50 so that drywall compound 13 is more efficiently dispensed from head 51.

In use, pressurized drywall compound 13 supplied from a source 32 through supply line 30 is fed to in-line valve 26. The handle 34 on in-line valve 26 acts as an on/off control to selectively allow drywall compound flow at a certain pressure as dictated by adjustment of the needle valve control 24 to move through apparatus 10. Typically, drywall compound 13 entering the in-line valve 26 at 2,000-3,000 pounds per square inch will be stepped down by the internal restriction in the needle valve 22 to a pressure of at least 40-50 pounds per square inch. This enables the drywall compound 13 moving through the delivery tube 12 towards the pinch valve 36 (FIG. 1) to momentarily overcome the preset closing pressure of the diaphragm 40 and travel through the pinch valve 36 and coupling 42 for delivery to the head 51. The system is designed so that while the pressure of drywall compound 13 in delivery tube 12 remains substantially constant, the handle 34 can be adjusted relative to the body of the in-line valve 26 to alter the volume of the drywall compound 13 to be delivered to the head 51 as desired.

When the diaphragm 40 is moved to the open position, the pressurized air acting on the diaphragm 40 is forced back through to the flow control valve 44 back into the air reservoir 46. However, when it is desired to stop feeding the pressurized drywall compound 13, the handle 34 on in-line valve 26 is disengaged and the pressurized air in air receiver 46 will charge back into the pinch valve 36 so as to quickly snap the diaphragm 40 closed. In this manner, the wasted oozing of drywall compound 13 which typically occurs in prior art devices and the ensuing messy deposit which must be cleaned up is effectively prevented.

The present invention thus provides a pressurized drywall compound supply apparatus 10 for eliminating the need to repeatedly refill a storage body having a moveable plunger with large volumes of drywall compound 13 during taping and finishing operations. Instead, a substantially continuous flow of drywall compound 13 can be metered through an uninterrupted delivery tube 12 to a dispensing head 51 in a manner which, of itself, dramatically increases the operating efficiency in drywall panel erection. In enhancing the operability of the apparatus 10, the filled weight of the apparatus 10 is generally about ⅓ the weight of a prior art filled apparatus. Using the various components described above, particularly the precharged pinch valve 36, provides for improving the starting and stopping of drywall compound flow relative to the dispensing head 51. In addition to its reduced weight, the handling of the apparatus 10 is enhanced by the swivel mounting of the in-line valve 26 and the needle valve 22 on the bottom end of the apparatus 12. A large number of the key components including the in-line valve 26, the needle valve 22, the pinch valve 36, the flow control valve 44, the pressure gauge 48 and the charging valve and cap unit 50 are commercially available items which contribute to minimizing the overall manufacturing costs.

FIG. 2 shows an alternative embodiment in which the pinch valve 36, flow control valve 44, air reservoir 46, pressure gauge 48 and unit 50 are replaced by a ball and spring valve 53. The ball and spring valve 53 includes a valve body 54 having one end which is threadably coupled to head 51. The valve body 54 has a throughbore with an enlarged portion for retaining a coil spring 55. One end of the spring 55 engages an inner wall of the valve body 54, and the other end of the spring 55 engages a ball 56. The ball 56 is biased by spring 55 against a delivery channel formed in a removable seat 57 which is interposed between an opposite end of the valve body 54 and a seat holder 58 threadably attached to the outer surface of that opposite end. The seat holder 58 has a throughbore in alignment with the valve body throughbore which is, in turn, in alignment with the head 51 and the removable seat channel. The seat holder 58 is further threaded on the outer surface 16 of delivery tube 12 which carries the drywall compound 13. The ball and spring valve 53 functions as a pressure sensitive valve arrangement wherein the pressure of the drywall compound 13 overcomes the closing pressure of the spring 55 on ball 56 against the channel in the seat 57 to provide a substantially continuous flow of drywall compound 13 to the head 51.

It should be understood that the invention contemplates that the air-actuated pinch valve 36 may alternatively be provided as a mechanical pinch valve.

Having described the presently preferred embodiments, it is to be understood that the invention may be otherwise embodied within the scope of the appended claims.

We claim:

1. An apparatus for permitting a substantially continuous flow of drywall compound to a wallboard joint comprising:

a delivery tube for delivering drywall compound completely therethrough, the delivery tube having a first end connected to a drywall compound supply assembly fed directly by drywall compound pressurized from a source, and a second end opposite the first end in communication with a drywall compound dispensing head, there being a normally closed, pneumatically pressure operated valve arrangement interposed between the second end of the delivery tube and the dispensing head for controlling the starting and stopping of drywall compound flow between the delivery tube and the dispensing head, the pneumatically pressure operated valve arrangement being normally and automatically closed by a continuously applied stored preset force independent of the source for pressurizing the drywall compound, pressure of the drywall compound in the delivery tube overcoming the preset force of the valve arrangement to provide a substantially continuous flow of drywall compound to the dispensing head, wherein the valve arrangement includes a pinch valve having a flexible diaphragm provided with a closing pressure for controlling the flow of pressurized drywall compound through the pinch valve, and wherein the pinch valve is joined to and in communication with a one way flow control valve and a normally closed precharged air reservoir located away from the drywall compound flow for storing an amount of precharged air therein, the air reservoir having a pressure gauge and a charging valve and cap unit adapted to be connected to a source of pressurized air.

2. The apparatus of claim 1, wherein the delivery tube is surrounded by a protective foam sleeve.

3. The apparatus of claim 1, wherein the drywall compound supply assembly includes a live swivel rotatably coupled to a needle valve and an in-line valve.

4. The apparatus of claim 3, wherein the needle valve has an adjustment control for altering the volume of pressurized drywall compound supplied through the in-line valve.

5. The apparatus of claim 4, wherein the in-line valve includes a handle for controlling the admission of pressurized drywall compound therethrough.

6. The apparatus of claim 1, including a coupling interposed between the pinch valve and the dispensing head.

7. The apparatus of claim 3, wherein the needle valve steps down the pressure of the drywall compound delivered from the in-line valve into the delivery tube.

* * * * *

UNITED STATES PATENT AND TRADEMARK OFFICE

CERTIFICATE OF CORRECTION

PATENT NO. : 7,628,295 B2
APPLICATION NO. : 11/330313
DATED : December 8, 2009
INVENTOR(S) : Mondloch et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 726 days.

Signed and Sealed this

Second Day of November, 2010

David J. Kappos

David J. Kappos
*Director of the United States Patent and Trademark Office*